US010038250B2

(12) United States Patent
Abreu et al.

(10) Patent No.: US 10,038,250 B2
(45) Date of Patent: Jul. 31, 2018

(54) PARABOLIC ANTENNA WITH SELF-STRUCTURED REFLECTOR

(71) Applicants: João do Espírito Santo Abreu, Curitiba (BR); João Alexandre de Abreu, Curitiba (BR)

(72) Inventors: João do Espírito Santo Abreu, Curitiba (BR); João Alexandre de Abreu, Curitiba (BR)

( * ) Notice: Subject to any disclaimer, the term of this patent is extended or adjusted under 35 U.S.C. 154(b) by 0 days.

(21) Appl. No.: 15/310,211

(22) PCT Filed: May 29, 2015

(86) PCT No.: PCT/BR2015/000082
§ 371 (c)(1),
(2) Date: Nov. 10, 2016

(87) PCT Pub. No.: WO2015/184518
PCT Pub. Date: Dec. 10, 2015

(65) Prior Publication Data

US 2017/0162946 A1 Jun. 8, 2017

(30) Foreign Application Priority Data

Jun. 4, 2014 (BR) ..... 202014013528

(51) Int. Cl.
*H01Q 15/16* (2006.01)
*H01Q 1/12* (2006.01)
(Continued)

(52) U.S. Cl.
CPC ..... *H01Q 15/16* (2013.01); *H01Q 1/1207* (2013.01); *H01Q 1/1242* (2013.01);
(Continued)

(58) Field of Classification Search
CPC ..... H01Q 15/16; H01Q 1/12; H01Q 15/14; H01Q 19/13
(Continued)

(56) References Cited

U.S. PATENT DOCUMENTS 2,471,828 A 5/1949 Mautner
2,997,712 A 8/1961 Kennedy
(Continued)

FOREIGN PATENT DOCUMENTS

EP 0196607 A2 10/1986

OTHER PUBLICATIONS

PCT International Search Report dated Jul. 22, 2015 from corresponding Application No. PCT/BR2015/000082.

*Primary Examiner* — Andrea Lindgren Baltzell
(74) *Attorney, Agent, or Firm* — Dilworth IP, LLC

(57) ABSTRACT

The present invention relates to a parabolic antenna having a base, mounting pole head unit, rear structure, support pole, low noise converter, and reflector, said reflector being made in a single piece in laminated expanded screen, and having a perfectly parabolic, self-structured shape without any bearing frame, fastened to the rear structure of the parabolic antenna by means of a fastening unit, and having a reinforcement edge facing away from the concavity of the reflector, and rolled or in one or two levels in the peripheral region of the reflector, said reflector having one or more non-perforated or smooth sections, in arbitrary vertical, and/or horizontal orientations, extending over the fastening unit.

2 Claims, 4 Drawing Sheets

(51) Int. Cl.
*H01Q 15/14* (2006.01)
*H01Q 19/13* (2006.01)

(52) U.S. Cl.
CPC ..... *H01Q 15/141* (2013.01); *H01Q 15/142* (2013.01); *H01Q 15/168* (2013.01); *H01Q 19/13* (2013.01)

(58) Field of Classification Search
USPC ..... 343/840
See application file for complete search history.

(56) References Cited

U.S. PATENT DOCUMENTS

| | | | | |
|---|---|---|---|---|
| 3,234,550 | A | 2/1966 | Thomas | |
| 3,397,399 | A | 8/1968 | Carman et al. | |
| 4,378,561 | A | 3/1983 | Hibbard et al. | |
| 4,568,945 | A | 2/1986 | Winegard et al. | |
| 4,578,682 | A | 3/1986 | Hooper et al. | |
| 4,647,943 | A | 3/1987 | Metcalfe | |
| 5,421,376 | A * | 6/1995 | Sinha ..... | D03D 19/00 139/419 |
| 6,911,958 | B2 * | 6/2005 | Swarup ..... | H01Q 1/005 343/878 |

* cited by examiner

PARABOLIC ANTENNA WITH SELF-STRUCTURED REFLECTOR

FIELD OF APPLICATION

The present invention belongs to the field of telecommunication equipment industry, notably for satellite communication antennas.

INTRODUCTION

The present invention relates to a constructive disposition introduced into a telecommunication antenna, especially in the type of satellite communication antenna used, for example, for the reception of pay television signals via satellite or DTH (Direct-to-Home), commonly known as parabolic antenna The parabolic antenna according to the present invention is equipped with a self-structured reflector set in a perfectly parabolic shape, made from laminated expanded screen, having a lightweight, rigid, and permeable to the wind construction, optimizing the use of metallic material and consequently reducing the manufacturing cost.

STATE OF THE ART

Even so the preferred constructive form for DTH parabolic antennas is that one including metallic reflectors, usually solid ones, especially for providing accuracy to the reflective surface at levels smaller than 0.5 mm RMS (Root-Mean-Square or root mean square error), various technical solutions that feature the reflective surface built in screen, especially a metallic screen, are known from the state of the art, as shown, for example, by the patent document U.S. Pat. No. 4,568,945.

The advantage of using metallic screens instead of solid metal plates is to obtain a surface that, in addition to being lighter, offers less wind resistance and enables the construction of lighter antennas in general. The disadvantage of using screens is the lack of stiffness of the same and the consequent demand for structural elements that allow the construction of minimally stiff reflective surfaces.

This construction is made, usually, by segmentation of the reflective surface, as shown, for example, in patent documents U.S. Pat. Nos. 4,578,682, 2,997,712, 3,234,550 and 4,647,943 in various segments supported by ribs, struts, stringers, fins, finally, a series of components that increase the amount of items in an antenna, its mounting complexity and, almost always, the final mass.

In addition, segmentation of the reflective surface and the lack of structural stiffness of the metal screens make it impossible to obtain a parabolic shape as perfect as the ones made from rigid printed screens in one solid piece, resulting in semi-parabolic or umbrella-shaped antennas.

Said deficiency is evident observing the aforementioned documents and also documents U.S. Pat. Nos. 2,471,828, 4,378,561 and, in particular, document U.S. Pat. No. 3,397, 399.

There is, therefore, room for a constructive disposition introduced in telecommunications antenna to provide a parabolic antenna equipped with self-structured reflector set manufactured in one single piece in laminated expanded screen and perfectly parabolic shape.

SUMMARY OF THE INVENTION

The objective of the present invention is, thus, providing a parabolic antenna with self-structured reflector according to the features of claim 1 in the appended set of claims. Variation of shape or detail related to constituent elements of the model that do not alter the technical-functional unit and the body unit in the matter of claim 1, are defined in the dependent claim in the appended set of claims.

BRIEF DESCRIPTION OF THE DRAWINGS

For a better understanding and visualization of the object of the present invention, the same will now be described with reference to the attached drawings, representing the functional improvement obtained wherein, schematically.

DETAILED DESCRIPTION OF THE INVENTION

Figure 1:
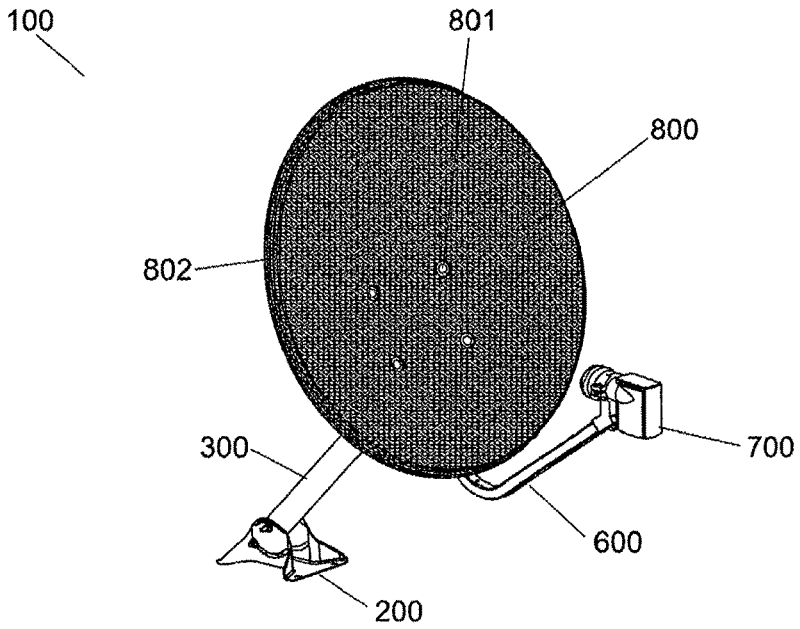
FIG. 1: is an anterolateral perspective view of a parabolic antenna with self-structured reflector according to the invention.
Figure 2:
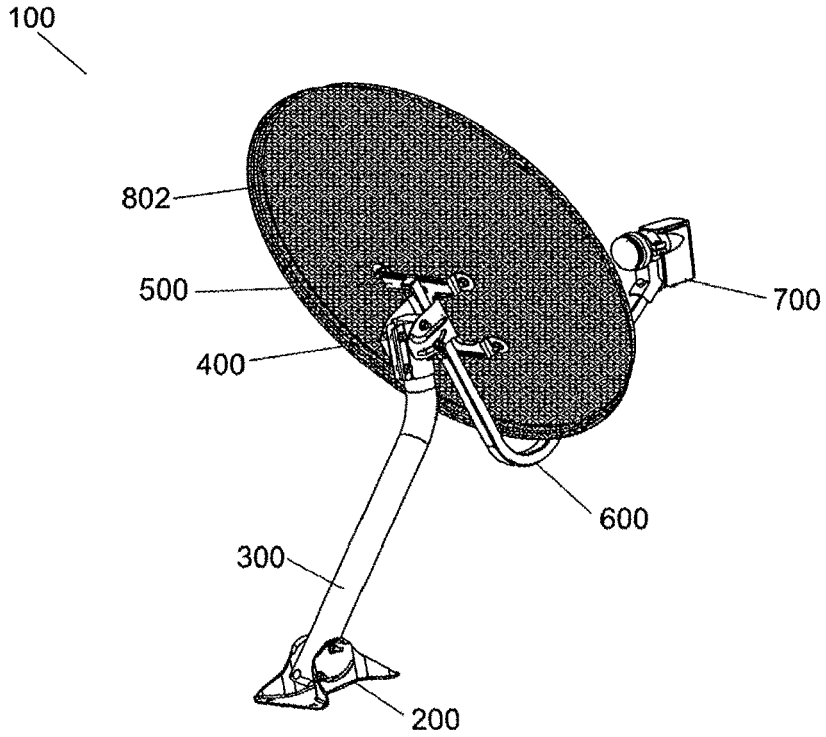
FIG. 2: is a posterolateral perspective view of a parabolic antenna with self-structured reflector according to the invention.
Figure 3:
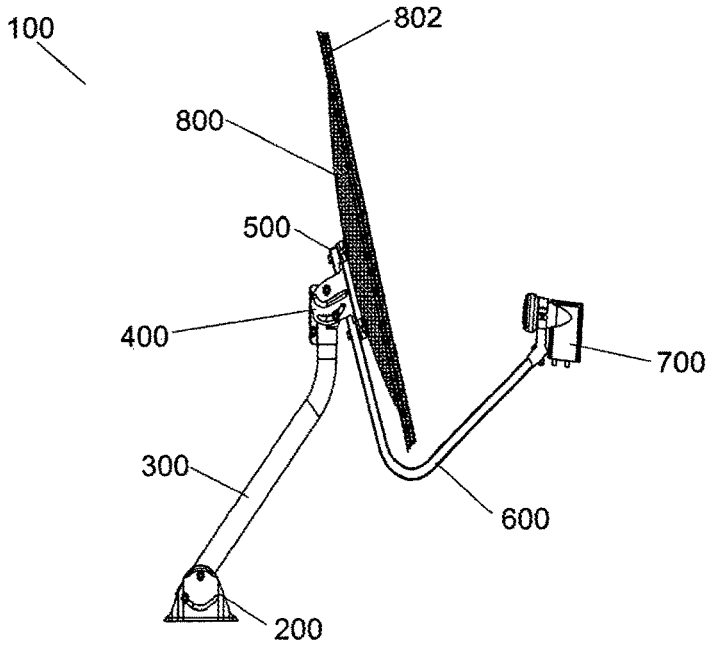
FIG. 3: is a side perspective view of a parabolic antenna with self-structured reflector according to the invention.
Figure 4:
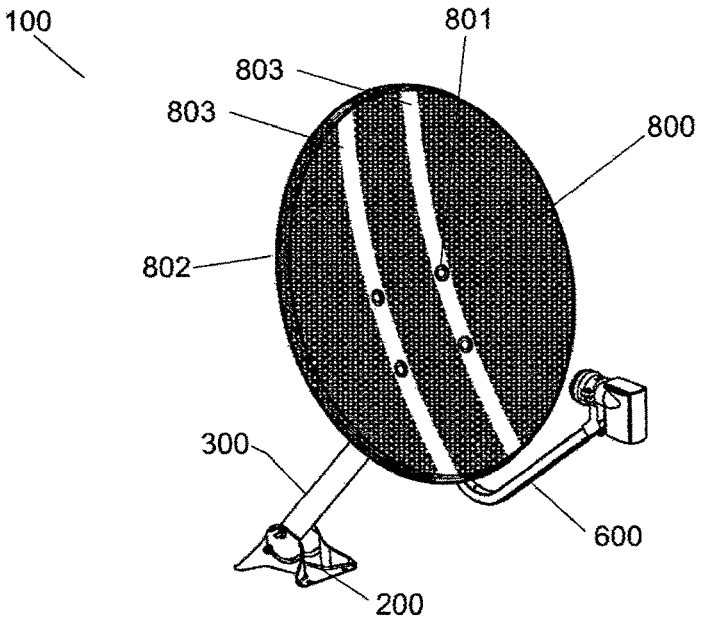
FIG. 4: is an anterolateral perspective view of a shape variation of the parabolic antenna with self-structured reflector according to the invention.
Figure 5:
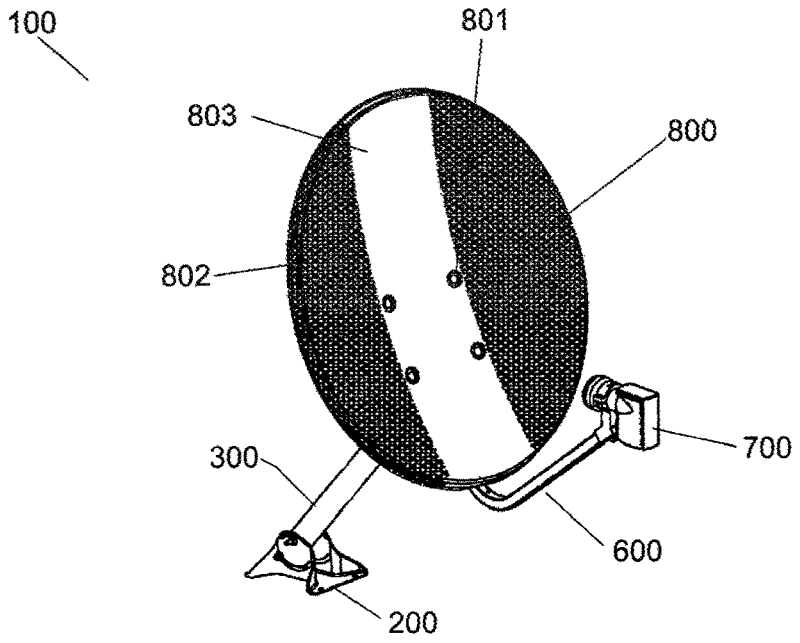
FIG. 5: is an anterolateral perspective view of a shape variation of the parabolic antenna with self-structured reflector according to the invention.
Figure 6:
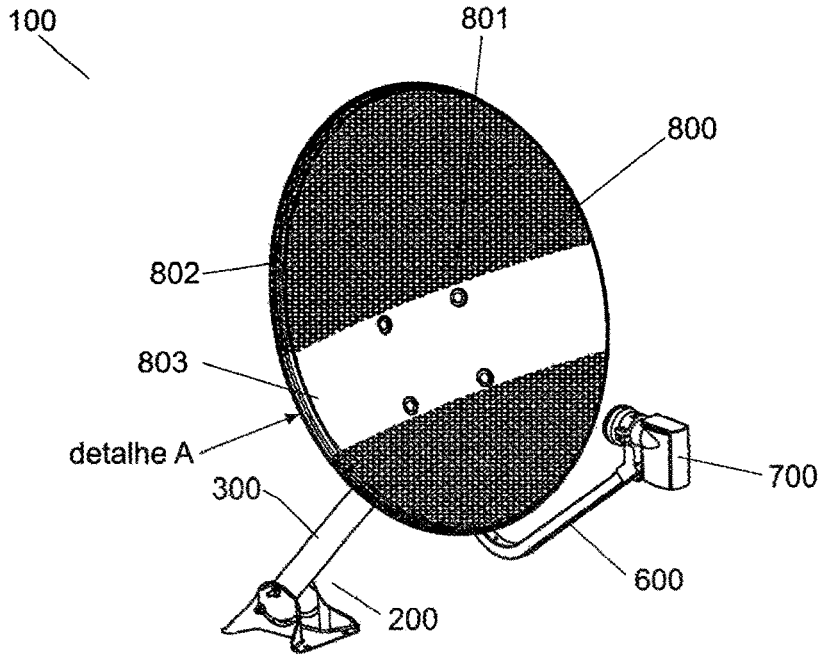
FIG. 6: is an anterolateral perspective view of a shape variation of the parabolic antenna with self-structured reflector according to the invention.
Figure 7:
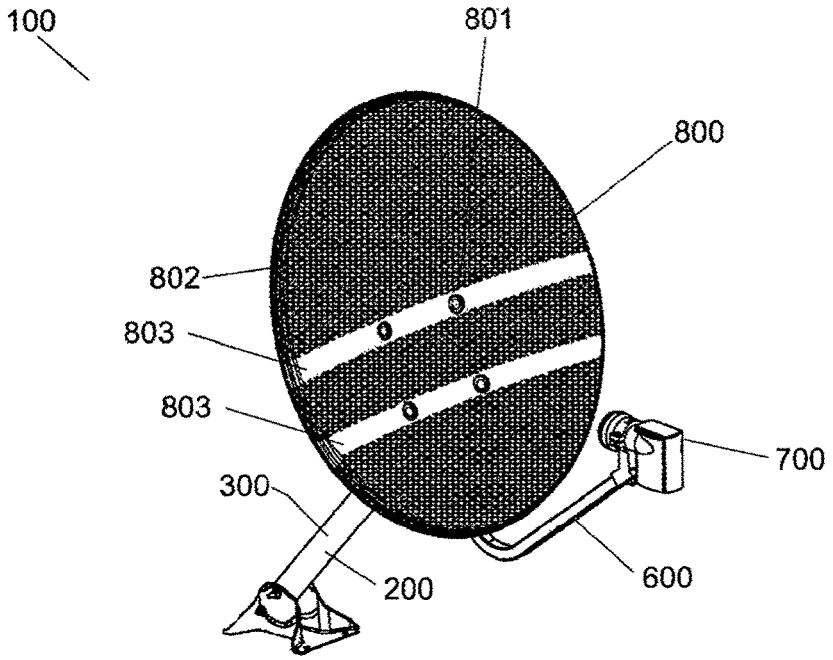
FIG. 7: is an anterolateral perspective view of a shape variation of the parabolic antenna with self-structured reflector according to the invention.

FIGS. 1, 2 and 3 show a parabolic antenna (100) with a base (200), a mounting pole (300), head unit (400), rear structure (500), support pole (600) and low noise converter (700), usual in the state of the art and to the skilled in the art, not demanding, therefore, greater details.

Figure 8:
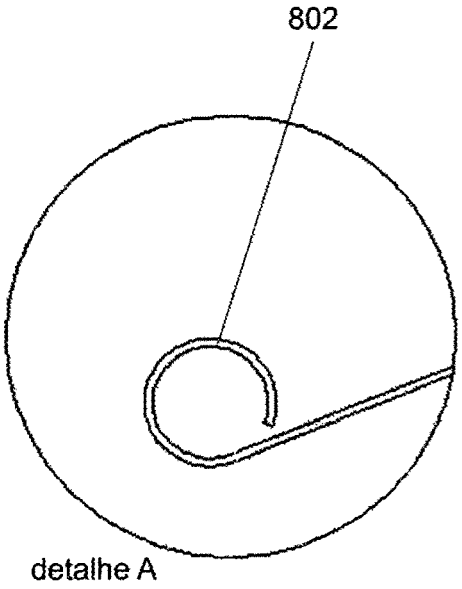
FIG. 8: shows detail "A" of FIG. 6, in a rolled condition.
Figure 9:
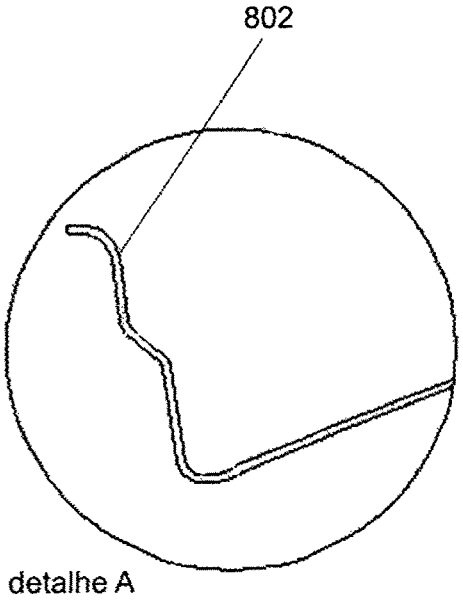
FIG. 9: shows detail "A" of FIG. 6, in one or two levels.

A parabolic antenna (100) according to the present invention_with a reflector (800) being made in a single piece, fastened to the rear structure (500) of the parabolic antenna (100) by means of a fastening unit (801), and having a reinforcement edge (802) facing away from the concavity of the reflector (800), and made in a rolled form (FIG. 8) or in one or two levels (FIG. 9) in the peripheral region of the reflector (800).

Thus, a reflector (800) equipped with a reflective surface with a perfect parabolic profile is obtained, and so, with superior performance to the models with conventional state of the art screens described above.

In addition, the parabolic antenna (100) having the reflector (800) according to the present invention does not require structural ribs and bearing frames, thus being lighter and having lower manufacturing cost in comparison to known screen antennas.

For the allocation of a mechanical reinforcement to the parabolic antenna (100) and, thus also the construction of parabolic antennas (100) of larger diameters, the reflector (800) can be equipped with one or more non-perforated or smooth sections (803), in random directions, for example, vertical and/or horizontal, which preferably pass over the fastening unit (801), as can be inferred from FIGS. 4, 5, 6 and 7.

As can be inferred from the description above, the constructive disposition according to the present invention surpasses the state of the art, being an object of practical use, perfectly susceptible of industrial application, comprising a new disposition, involving inventive step and resulting in functional improvement in its use, providing a parabolic antenna (100) with a self-structured reflector (800) made in a single piece in laminated expanded screen, and having a perfectly parabolic shape.

The invention claimed is:

1. Parabolic antenna with self-structured reflector, having a base, mounting pole, head unit, rear structure, support pole, low noise converter, and reflector, characterized in that said reflector is made in a single piece in laminated expanded screen, that has a parabolic, self-structured shape without any bearing frame, fastened to the rear structure of the parabolic antenna by means of a fastening unit and having a reinforcement edge facing away from the concavity of the reflector, and rolled or in one or two levels in the peripheral region of the reflector.

2. The parabolic antenna according to claim 1, characterized in that it comprises one or more perforated or smooth sections, in arbitrary vertical and/or horizontal orientations extending over the fastening unit.

* * * * *